United States Patent [19]

Groft

[11] Patent Number: 4,655,528

[45] Date of Patent: Apr. 7, 1987

[54] CONNECTOR FOR RIBBON CABLE

[75] Inventor: James L. Groft, McSherrystown, Pa.

[73] Assignee: AMP Incorporated, Harrisburg, Pa.

[21] Appl. No.: 761,990

[22] Filed: Aug. 2, 1985

Related U.S. Application Data

[63] Continuation-in-part of Ser. No. 679,340, Dec. 4, 1984, abandoned.

[51] Int. Cl.[4] ..... H01R 4/24

[52] U.S. Cl. ..... 339/99 R

[58] Field of Search ..... 339/97 R, 97 P, 98, 339/99 R

[56] References Cited

U.S. PATENT DOCUMENTS 4,171,858 10/1979 Knowles et al. ..... 339/99 R 4,255,009 3/1981 Clark ..... 339/99 R 4,317,608 3/1982 Dechelette ..... 339/99 R 4,439,001 3/1984 Curley et al. ..... 339/98

*Primary Examiner*—Joseph H. McGlynn

*Attorney, Agent, or Firm*—F. Brice Faller; Bruce J. Wolstoncroft; David L. Smith

[57] ABSTRACT

Connector for ribbon cable comprises a housing having rows of terminals with C-shaped body portions in respective rows of passages of square cross section. Each body portion has a substantially planar first plate which extends to a coplanar slotted plate portion which receives a cable conductor. The plate is stamped with opposed lugs which engage opposite walls of the passage for angular orientation which does not depend on formed dimensions of the body portion.

6 Claims, 7 Drawing Figures

18
48
42
26
28
32
30
24
22
26
34
36
10
14
12
15
40
38
15
20
16

5
4
6
2
3
14
42
48
10
12
18
42
22

CONNECTOR FOR RIBBON CABLE

This application is a continuation-in-part of U.S. patent application Ser. No. 679,340 filed Dec. 14, 1984, now abandoned.

BACKGROUND OF THE INVENTION

The present invention relates to a connector for ribbon cable, and particularly to improved means for aligning terminals in the housing.

Ribbon cable provides a convenient means for handling multiple conductors, and is typically manufactured with conductors on 0.050 inch centerline spacing in a common jacket of insulation. Accordingly, specialized connectors having insulation displacing terminals with slotted plates on 0.050 inch centerline spacing have been developed. Typically, such connectors have two rows of terminals spaced on 0.100 inch centers, the slotted plates in each row being offset from the slotted plates in the other row so that each row of terminals terminates alternate conductors in the cable. An early connector of this type, which is sold by AMP Incorporated under the trademark AMP-LATCH, is disclosed in U.S. Pat. No. 3,820,055.

U.S. Pat. No. 4,367,004 discloses an electrical connector of the type comprising an insulative housing having a mating end, a cable receiving end, and a plurality of terminal passages extending therebetween, the passages being of generally square cross section. The connector further comprises a plurality of stamped and formed terminals received in respective passages, each terminal having a body portion of generally C-shaped cross-section, the body portion comprising a substantially planar first plate extending to a coplanar slotted plate portion.

Terminals as described above generally depend on contact between the three plates of the C-shaped body portion and respective adjacent walls of the passage to angularly position the terminals in the housing. A detent may be stamped in one or more walls to provide an interference fit for retention. For such small terminals (about 0.070 inch square in the body portion), it is extremely difficult to control the formed dimensions relative to the terminal size. Since stamped dimensions are relatively easy to control, an oversized formed dimension means that another dimension formed within the same stamped dimension will be undersized. Most notably, a plate of oversized width means that one or two of the other plates will be undersized.

This in turn affects the angular orientation of the terminals in respective passages, and likewise the centerline spacing of the slotted plate portions. Considering also the tolerances in spacing of conductors in the ribbon cable, damage or even severing of one or more such conductors is possible.

SUMMARY OF THE INVENTION According to the invention, the first plate of the body portion of each terminal is stamped with a pair of opposed lugs which engage opposite walls of the passage. The other two plates of the body portion do not contact adjacent walls of the passage and thus do not affect angular orientation of the terminals. Since it is possible to control the stamped dimension between lugs with some precision, and further possible with passage lead-ins to control the engagement points of respective lugs, it is possible to control the angular position of terminals in respective passages. Since each slotted plate is stamped in the same plane as the first plate, it is likewise possible to control the centerline spacing of the slots. The likelihood of damage to conductors in the ribbon cable is thus considerably reduced.

An additional advantage is achieved where the mating end of the terminal comprises cantilever arms extending from parallel plates of the body portion. Precise angular orientation of the terminal assures that parallel surfaces of the mating ends of the arms will contact opposite sides, rather than edges, of a mating pin.

DETAILED DESCRIPTION OF THE PREFERRED EMBODIMENT

Figure 1:
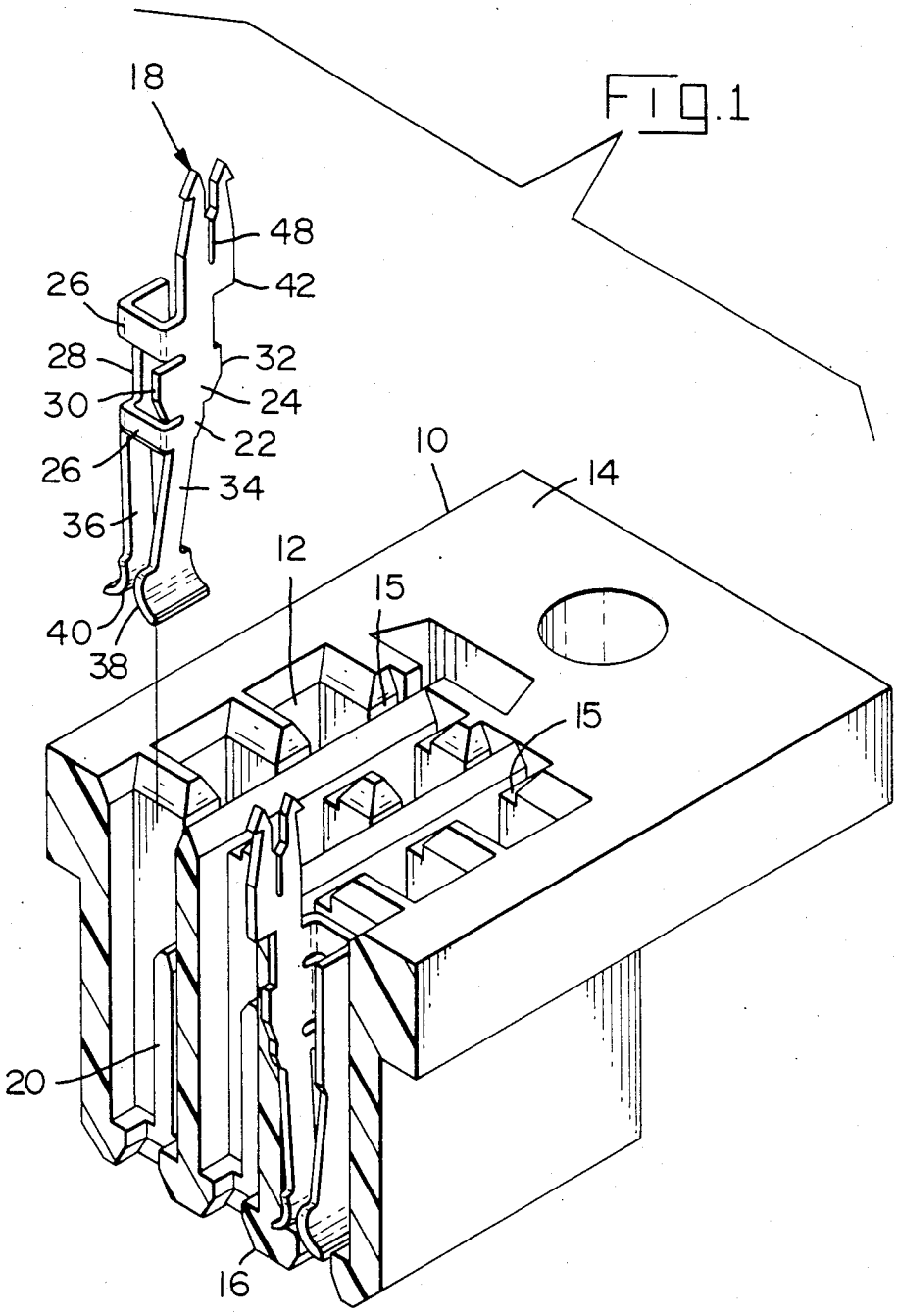
FIG. 1 is an exploded perspective of a sectioned connector.

Referring to FIG. 1, the inventive connector comprises a dielectric housing 10 having a cable receiving end 14, a mating end 16, and a plurality of terminal receiving passages 12 extending therebetween. Each passage 12 is of generally square cross section and has a pair of ribs 20 on opposite walls extending from proximate the mating end 16 toward the cable receiving end 14. A pair of lead-ins 15 in opposed walls of each passage 12 at cable receiving end 14 serve to position terminals 18 received therein, as will be described.

Each terminal 18 is stamped and formed from conventional metal strip stock and comprises a body portion 22 of generally C-shaped cross-section having a first plate 24, a parallel third plate 28, and a second plate 26 (in two sections) extending substantially normally therebetween. The first and third plates 24, 28 have respective cantilever arms 34, 36 extending therefrom to contact surfaces 38, 40 for engaging a pin. The first plate 24 is stamped with a pair of opposed lugs 30, 32 which are received in passage lead-ins 15 to align the terminal 18 in passage 12. The first plate 24 further extends to a coplanar slotted plate 42; the slot 48 therein is offset 0.025 inch from the centerline of plate 24.

Figure 2:
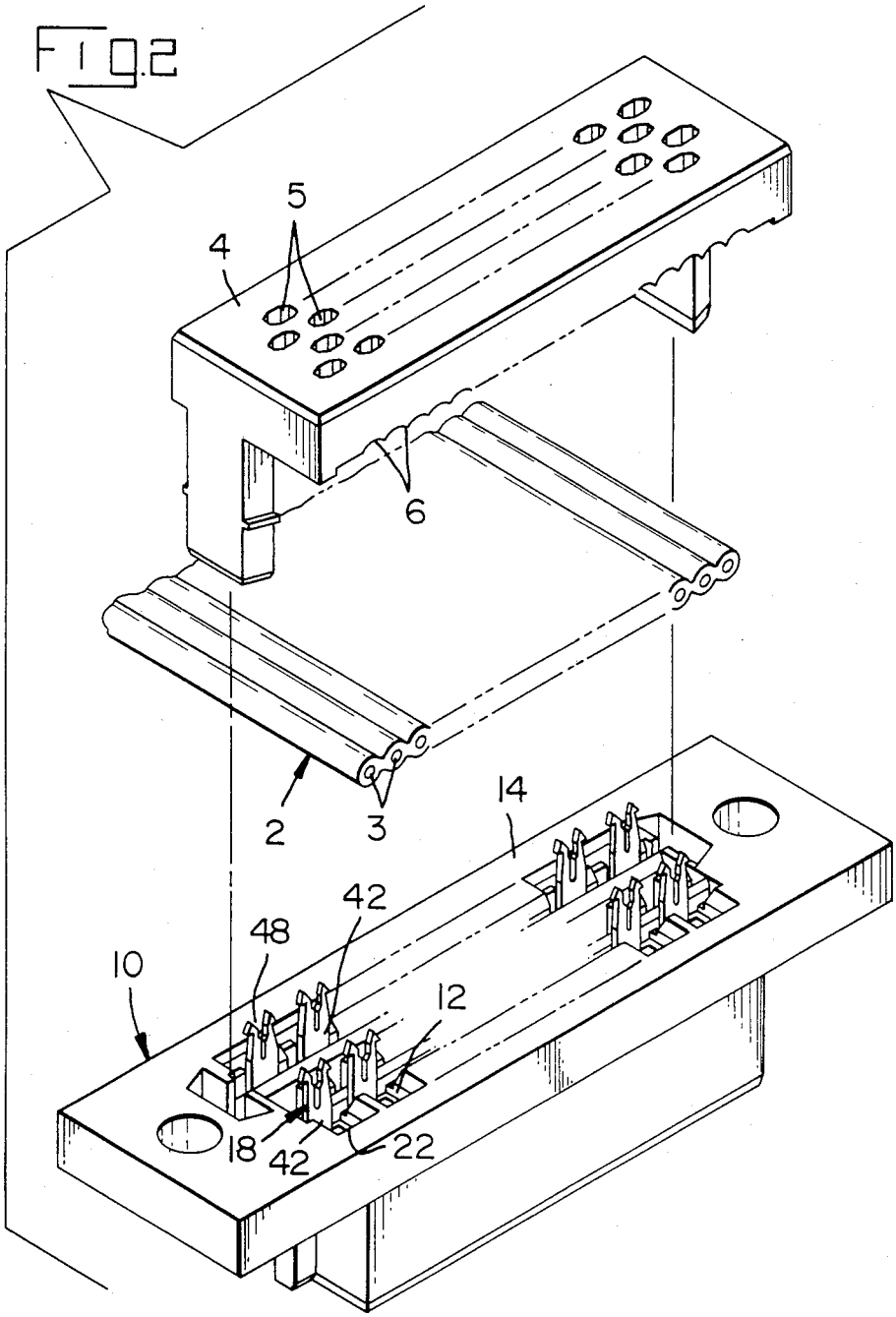
FIG. 2 is a perspective of the connector, ribbon cable, and cover.

FIG. 2 shows the assembled connector, with terminals 18 loaded in two rows of respective passages 12 of housing 10, the slotted plates 42 extending beyond cable receiving end 14. The slots 48 are spaced at 0.100 inch in each row and are offset 0.050 inch from slots 48 in the other row in order to terminate conductors 3 on 0.050 inch spacing in cable 2. The conductors 3 are aligned relative to housing 10 by flutes 6 in cover 4, the slotted plates 42 being received in apertures 5 to latch the cover 4 to the housing 10. In order for terminals 18 to engage conductors 3 without damage, it is thus important that centerline spacing of slots 48 be closely maintained. Note that the passages 12 in each row are directly opposite respective passages in the adjacent row, the offset being achieved by the offset slotted plates 42 and opposite orientation of terminals between rows. The terminal 18 may be installed in the center row of passages in either of two orientations to yield three possible combinations of two rows of terminals to connect with any two of three rows of pins (see also FIG. 3).

Figure 3:
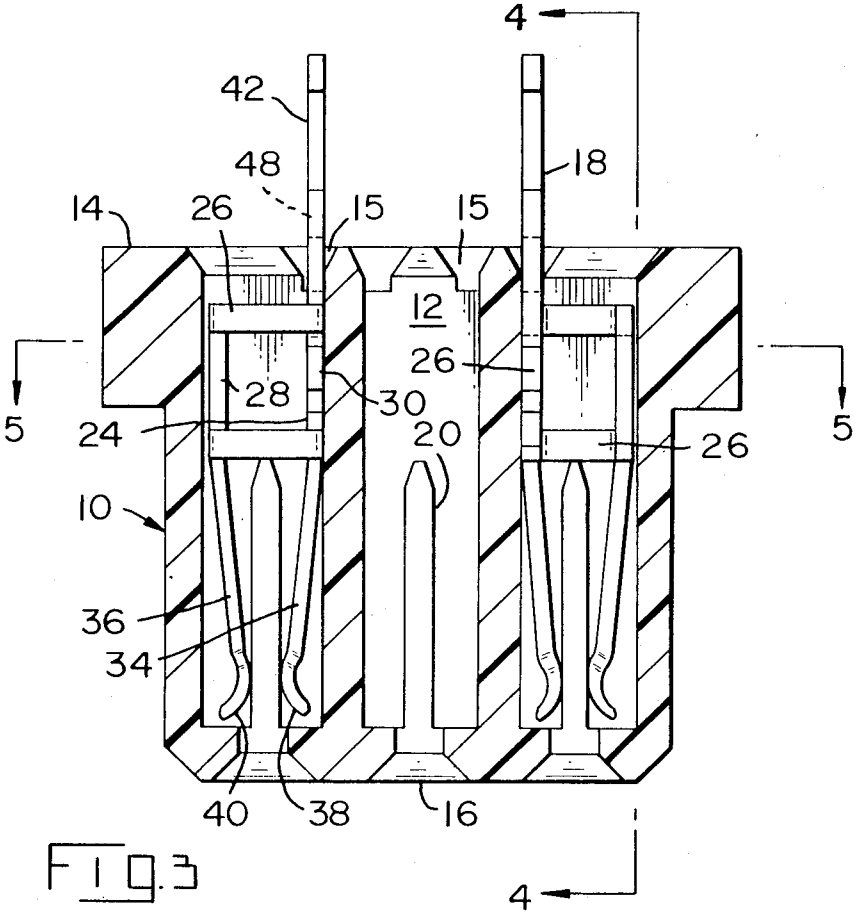
FIG. 3 is an end section of the connector.

FIG. 3 shows how terminals 18 are axially positioned in passages 12. Each rib 20 serves to prestress the cantilever arms 34, 36, the contact surfaces 38, 40 bearing against opposite sides of the rib. The rib 20 also serves as a stop to limit insertion depth of the terminal 18 and further serves to withstand the forces imposed during termination of the ribbon cable. Lead-ins 15 receive lugs 30, 32 and serve to position plate 24 flushly against the adjacent wall of passage 12.

Figure 4:
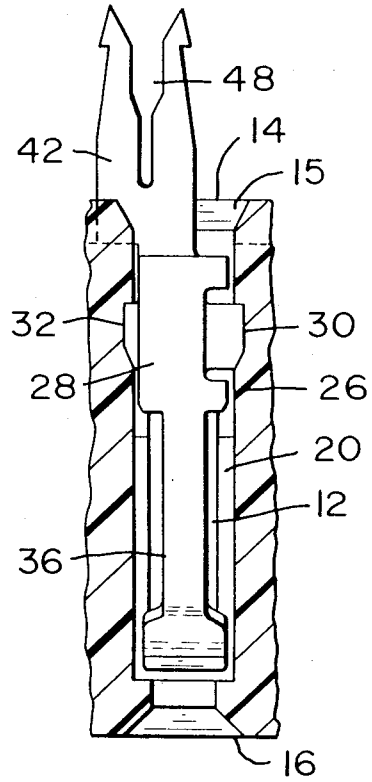
FIG. 4 is a partial side section taken along line 4—4 of FIG. 3.

FIG. 4 shows lugs 30, 32 engaged in opposite walls of passage 12. This is an interference fit in the plastic which not only maintains proper angular orientation of the terminal but retains it against withdrawal.

Figure 5:
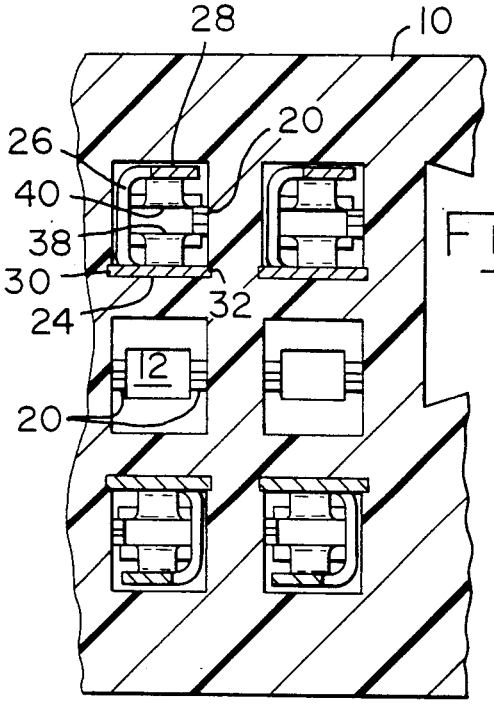
FIG. 5 is a partial plan section taken along line 5—5 of FIG. 3.

FIG. 5 is a section view taken through plates 24, 28 between the top and bottom sections of plate 26, showing the engagement of lugs 30, 32 in the housing 10. Clearance between plates 26, 28 and adjacent walls of passage 12 allows for any dimensional variations in forming plates 26, 28.

Figure 6:
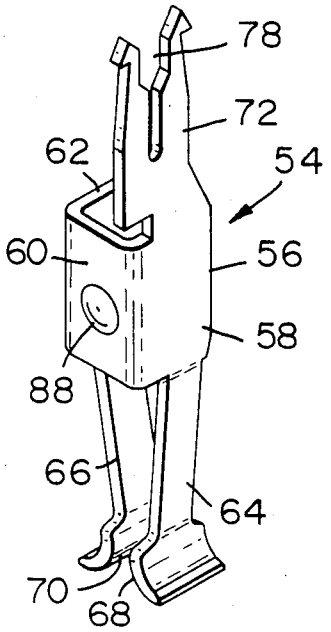
FIG. 6 PRIOR ART
FIG. 6 is a pespective of a prior art terminal.

FIG. 6 depicts a terminal 54 according to the teaching of the prior art, which terminal comprises a body portion 54 having first, second and third plates 56, 58, 60, respectively, and a slotted plate 72 extending from first plate 58 coplanar therewith. Cantilever arms 64, 68 extend from respective plates 58, 62 and have contact portions 68, 70.

Figure 7:
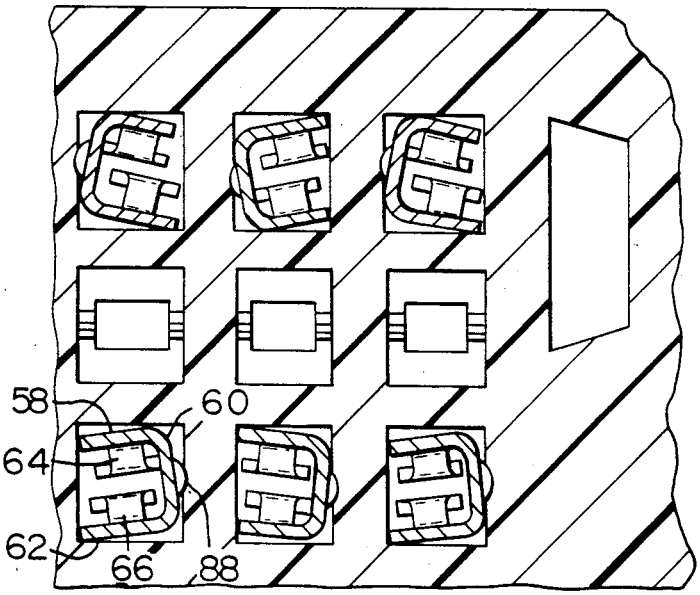
FIG. 7 PRIOR ART
FIG. 7 is a partial plan section similar to FIG. 5 with the prior art terminal.

FIG. 7 depicts the prior art terminals 54 loaded in a housing and illustrates the alignment problem. Since the terminals 54 are received in respective passages in an interference fit between first plate 58, dimple 88 on second plate 60, third plate 62, and adjacent walls of the passage, any dimensional variations in the width of the plates translates into terminal orientation. The terminals may thus end up skewed, adversely affected the centerline spacing of slots 78. This skewing is exaggerated for purposes of illustration.

The foregoing is exemplary and not intended to limit the scope of the claims which follow.

I claim:

1. An electrical connector for use in establishing electrical connections to the conductors of a flat cable of the type comprising a plurality of conductors held in spaced side-by-side parallel relationship by plastic insulating material, the electrical connector comprising:

a housing member having a mating end and a cable receiving end;

a plurality of terminal passages extending from the mating end through the cable receiving end;

a like plurality of terminals positioned in the passages having cantilever contact engaging members extending from a midsection of the terminals; and a rib positioned in the passages on a wall thereof, the ribs extend from proximate the mating end toward the cable receiving end, the end of the rib toward the cable receiving end of the passage being tapered, the tapered end of the rib providing diverging surfaces such that as a terminal is inserted into the passage the cantilever contact engaging members engage respective tapered surfaces, forcing the members into the prestressed position to allow for insertion of a matable contact under reduced insertion force, the tapered end of the rib also engaging the bottom surface of the midsection of the terminal such that a stop position is reached thereby assuring that proper alignment of the terminal is maintained, ensuring a positive electrical connection is established with the matable contact and preventing the terminal from axial movement during insertion of a conductor in the terminal.

2. An electrical connector as recited in claim 1 wherein each terminal has a generally C-shaped midsection which comprises a substantially planar first plate extending to a coplanar slotted plate position, the first plate being stamped with a pair of opposed lugs which engage opposite walls of the passage creating an interference fit of the terminals in the passages of the connector.

3. An electrical connector as recited in claim 2 wherein each passage has a pair of lead-ins at the cable receiving end for guiding the respective lugs of the terminals into the passages.

4. An electrical connector for termination of flat ribbon cable comprising:

a dielectric housing member having a cable receiving end, a mating end, and a plurality of rectangular-shaped passages extending therethrough, each of said passages having a rib on a wall thereof, said rib extending from proximate the mating end to a tapered end toward the cable receiving end of the passages; and a like plurality of terminals received in respective passages, each terminal comprising a body portion of generally C-shaped cross-section having a first plate, a parallel third plate, and a second plate extending substantially normally therebetween and engaging the tapered end of the rib, the first and third plates having respective cantilever arms extending therefrom to contact surfaces for engaging a pine, said cantilever arms maintained in a prestressed position by the rib to allow insertion of a mating contact under reduced insertion force, the first plate extending to a coplanar slotted plate, the first plate having a pair of opposed lugs which are received in passage lead-ins to align the terminals in the passage as the terminals are inserted into the passages, the lugs cooperate with the walls of the passage to provide an interference fit in the dielectric housing member so as to maintain proper angular orientation of the terminal as well as retain the terminal against withdrawal.

5. An electrical connector as recited in claim 4 wherein each passage has a pair of lead-ins at the cable receiving end for guiding respective lugs into the passage.

6. An electrical connector as recited in claim 4 wherein the first plate of the body portion is received substantially flushly against one wall of the passage.

* * * * *